US005345477A

United States Patent [19]

Wieland et al.

[11] Patent Number: 5,345,477

[45] Date of Patent: Sep. 6, 1994

[54] DEVICE AND PROCESS FOR THE PRODUCTION OF NITROGEN-13 AMMONIUM IONS USING A HIGH PRESSURE TARGET CONTAINING A DILUTE SOLUTION OF ETHANOL IN WATER

[75] Inventors: Bruce W. Wieland, El Cerrito; Gerald T. Bida, Rodeo; George O. Hendry, Napa; Henry C. Padgett, Walnut Creek, all of Calif.

[73] Assignee: CTI Cyclotron Systems, Inc., Knoxville, Tenn.

[21] Appl. No.: 717,268

[22] Filed: Jun. 19, 1991

[51] Int. Cl.[5] ..... G21G 1/10

[52] U.S. Cl. ..... 376/195

[58] Field of Search ..... 376/194, 195

[56] References Cited

U.S. PATENT DOCUMENTS 2,868,987 1/1959 Salsig, Jr. et al. ..... 376/194
4,752,432 6/1988 Bida et al. ..... 376/195

OTHER PUBLICATIONS

Int. J. Appl. Radiat. & Isot., vol. 26, No. 5, (May 1975), pp. 316–318, Vaalburg et al.
Nuclear Instruments and Methods, vol. 88, No. 1, (1970), pp. 69–71, Nicholas et al.
Appl. Radiat. Isot., vol. 39, No. 10, pp. 1065–1071, (1988) Solin et al.
Appl. Radiat. Isot., vol. 40, No. 8, pp. 663–669, (1989), Heselius et al.
Appl. Radiat. Isot., vol. 38, No. 11, (1987), pp. 979–984, Iwata et al.

*Primary Examiner*—Behrend E. Harvey
*Attorney, Agent, or Firm*—Pitts & Brittian

[57] ABSTRACT

A system and process for the production of nitrogen-13 ammonium ions from a target material in the form of a dilute solution of ethanol in natural water by the reaction of protons with oxygen-16 within the target material. The system includes a device for producing a proton beam which travels along a preselected path and strikes the target material in a target chamber. This target chamber is positioned in the path of the proton beam such that subjection of the target material to the beam produces nitrogen-13 atoms in a predetermined form. These nitrogen-13 atoms are converted in the aqueous solution to ammonium, ions and oxides and are conducted from the target holder to a purification device for collecting a purified product containing such ammonium ions. A cooling system serves to dissipate heat generated during the production of the nitrogen-13 atoms by the reaction of protons with the oxygen. Other solutes for the target material are discussed.

7 Claims, 2 Drawing Sheets

DEVICE AND PROCESS FOR THE PRODUCTION OF NITROGEN-13 AMMONIUM IONS USING A HIGH PRESSURE TARGET CONTAINING A DILUTE SOLUTION OF ETHANOL IN WATER

TECHNICAL FIELD

This invention relates generally to the production of nitrogen-13 ammonium ions, and more particularly to the production of these ions using a cyclotron in which protons are utilized to bombard a dilute solution of a selected solute, such as ethanol, in water under high pressure conditions, with the recovery of the ions from this solution.

BACKGROUND ART

Nitrogen-13 is commonly used in scanning operations where an ammonium solution containing this isotope is introduced into the body, and the distribution monitored by state-of-the-art techniques. It is desirable to produce the nitrogen-13 by a relatively simple process so as to limit the cost of this medical technique. One known prior art method teaches the use of natural water in a batch or recirculating mode to produce predominantly nitrogen-13 oxides by proton irradiation. These oxides must be chemically reduced in a basic solution to ammonia which is then distilled and collected. Prior devices and methods employing this approach produce added complexity, chemical losses and processing time with concomitant crucial radioactive decay loss. Using this method in a large cyclotron (16 MeV) at about 20 μA of protons, about 175 mCi of ammonium ion is available in a time period of about twenty-five minutes after the initiation of bombardment.

A second known prior art method, as described in our U.S. Pat. No. 4,752,432 issued Jun. 21, 1988, teaches the use of direct production of nitrogen-13 ammonium ions in an aqueous carbon-13 slurry target. This process requires the use of expensive carbon powder highly enriched in carbon-13. Thus, it is limited in production to the use of low proton beam currents in order to prevent the carbon from stopping the flow through the target by plugging porous metal frits used to contain the powder. Using a cyclotron of about 11 MeV at about 3 μA, about twenty-five mCi of ammonium ion is produced in about 13 minutes.

A third known prior art method teaches direct production of nitrogen-13 ammonium ion in a target filled with natural water and maintained under a reducing overpressure of ten atmospheres of hydrogen gas. Reproducible production using this method requires the use of thoroughly degassed deionized target water and, in addition, the flushing of the target lines and the target with hydrogen gas just before loading and running the system. If these procedures are not carefully followed, experience has shown that most of the nitrogen-13 activity produced will be in the form of nitrogen gas and not ammonium ion. This method is also limited to 20 μA beam currents of 18 MeV protons. Experience has shown that if the proton current is above 20 μA, most of the nitrogen-13 produced will be in the form of nitrogen oxides and not ammonium ion.

Accordingly, it is an object of the present invention to provide a target capable of generating a higher yield of nitrogen-13 than possible with the prior art.

It is another object to provide for the direct production of the desired chemical form of nitrogen-13 ammonium ion in a simple continuous flow collection which precludes complex chemical processing and radioactive losses.

It is another object of the invention, with the utilization of 10.5 MeV protons entering the target at a beam current of about 40 μA, to produce about 100 mCi of nitrogen-13 ammonium ion in a time period of about 13 minutes.

A further object of the invention is to utilize the proton bombardment of a dilute natural water solution containing a solute that enhances conversion of nitrogen-13 atoms to nitrogen-13 ammonium ions with a lower production of nitrogen oxides.

It is also an object of the invention to utilize the proton bombardment of a dilute ethanol/natural water solution to produce nitrogen-13 ammonium ion.

These and other objects and advantages of the present invention will become apparent upon a consideration of the drawings and a complete description thereof that follow.

SUMMARY OF THE INVENTION

In accordance with the present invention, a system and a process are provided for the utilization of a target of a dilute solution of ethanol in natural water for the direct production of nitrogen-13 ammonium ions in an aqueous solution. The dilution of the target solution typically has an ethanol:water ratio of about 1:5000. The target solution is captured and maintained at high pressure, and washed out by additional target solution entering and leaving the target. Radioactive nitrogen-13 is produced in the natural oxygen-16 water by the p,α reaction. All of the radioactive nitrogen-13 atoms produced recoil and diffuse into the target water. The chemical form of the nitrogen-13 removed from the target by the one-pass flow is predominantly ammonium ion in aqueous solution. The radioactive effluent from the target is transported through a purification column to remove unwanted nitrogen oxides, and the resultant purified nitrogen-13 ammonium ion product is collected for use.

BEST MODE FOR CARRYING OUT THE INVENTION

Figure 1:
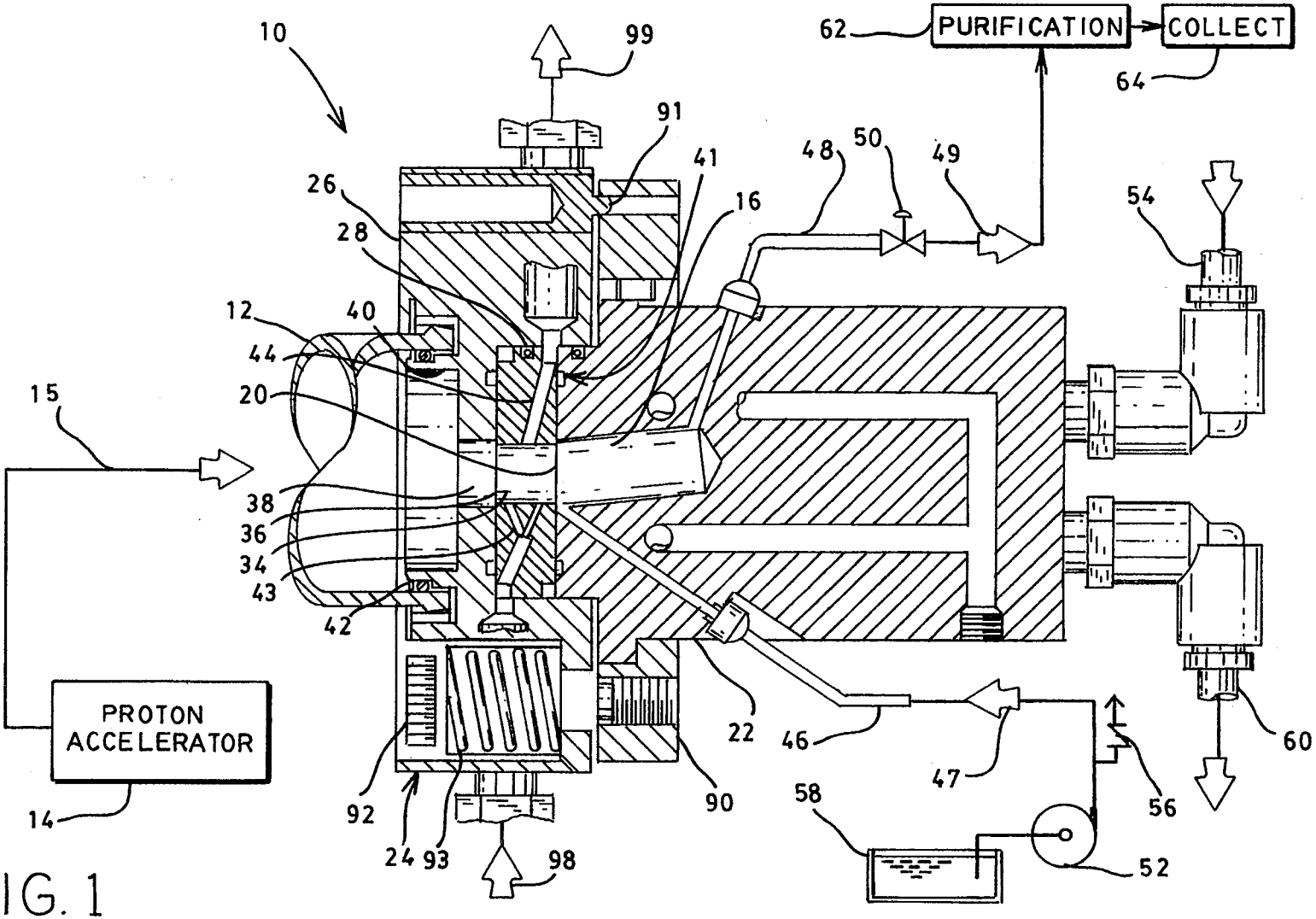
FIG. 1 is a sectional view of a target assembly device for use with the present invention, with a proton accelerator (cyclotron) indicated by a block diagram.

Referring now to the figures, and in particular to FIG. 1, a system for the utilization of a dilute ethanol/-water target for the direct production of nitrogen-13 ammonium ions in an aqueous solution is generally indicated at 10 therein. The system 10 includes means for producing a proton beam which travels along a preselected path. To this end, an evacuated accelerator beam tube 12 is connected to the output of a proton accelerator (cyclotron) indicated by the box 14. The production of protons with a cyclotron is well known in the prior art, and can be provided in the form of many types of apparatus for giving high energy to particles, usually protons, deuterons and helium ions. In the preferred embodiment of the invention, the cyclotron 14 provides a 10.5 to 11 MeV proton beam 15 of about 40 μA collimated to a ten mm diameter. However, it will be understood by those skilled in the art that differing diameters and intensities of proton beams can be provided by different means.

A target material 16 is aligned with the beam tube 12, as shown. The target material 16 is contained and held in position by a target window 20 and a target body 22. The volume of the target is made many times larger than needed to stop the bombarding protons so as to achieve good heat transfer in the system. In the preferred embodiment, the target material consists of ethanol typically present in a ratio of one part of ethanol to 5000 parts of natural water. It will be understood, however, that dilute target solutions using solutes, other than ethanol, that result in the production of ammonium ion in solution can be used, such as acetic acid in natural water. In the preferred embodiment the target window 20 is constructed of Havar alloy, but is understood that other metals, alloys or synthetic materials can be employed in construction of the target window 20 if the material is unaffected by the proton beam 15.

The alignment and attachment assembly of the target portion of the device 10 is indicated generally at 24. In addition to the window 20 and target body 22, this assembly 24 includes a nose piece 26, a window cooling spacer 28, alignment pins 91, body holder ring 90, shoulder bolts 92 and springs 93. The nose piece 26, spacer 28 and target body 22 are held firmly in place by screwing six of the spring-loaded shoulder bolts 92 through the nose piece 26 into the body holder ring 90. It will be recognized, however, that other structures can be used to achieve alignment and assembly of the device which accomplish the desired function.

The window cooling spacer 28 is seated against the target body 22 and has a centrally disposed window cooling space 34 which is aligned with the target window 20, the target material 16 and the beam tube 12. The window cooling space 34 is enclosed by a vacuum window 36 which is constructed, in the preferred embodiment, of aluminum. It will be understood that the vacuum window 36 can be constructed of various materials other than aluminum. This vacuum window 36 is attached to the spacer 28 at its forward most portion facing the beam tube 12, and is in alignment with and encloses the window cooling space 34. This space 34 is therefore bordered at its forward most portion by the vacuum window 36 and at its rearward most portion by the target window 20.

The nose piece 26 is provided with a centrally disposed forward beam reception space 38 which is aligned with the vacuum window 36 and with the beam tube 12. The nose piece 26 and the window cooling spacer 28 are used to hold and seal the vacuum window 36 and the target window 20 in place. The nose piece 26 is provided at its front most portion with a receptor ring 40 which receives and is attached to the beam tube 12. This receptor ring 40 is provided with a vacuum seal (typically an O-ring) 42 which is seated between the outer diameter of the receptor ring 40 and the inner diameter of the beam tube 12. The seal 42 is used to prevent leakage between the atmosphere and the vacuum tank of the cyclotron 14. Of course, it will be understood that other means of connecting the beam tube 12 and the nose piece 26 can be utilized.

Window sealing means are generally shown at 41 in FIG. 1. The preferred method of sealing uses rubber O-rings to apply high pressure to the target window 20 and the vacuum window 36. Other sealing means will be known to those versed in the art.

The window cooling space 34 is provided with one or more helium jets 43 which are used to cool the windows 20 and 36 to maintain even heat balance. Helium for the jets is provided from a helium source (not shown) via a helium inlet line 98 and outlet line 99. The space 34 is further provided with one or more gas exit vents 44 for escape of the cooling helium gas. It will be recognized, of course, that other means of window temperature balance, cooling, ventilation and source supply can be utilized.

The target body 22 is fitted with a recovery water inlet tube 46 and a recovery water outlet tube 48. These establish a flow of target solution, respectively, into conduit 46 in the direction of arrow 47 into the target, and then out of conduit 48 in the direction of arrow 49 after exiting the volume containing the target material 16. The time intervals and volumes of this water flow are chosen depending upon the production rate of the nitrogen-13 ions.

In the preferred embodiment of the present invention, the target solution 16 is prevented from flowing during irradiation by blocking the recovery outlet tube 48, as by closing valve 50, and is pressurized to about twenty-seven atmospheres by a pump 52. This pump is of the type commonly used in high pressure liquid chromatography which has been fitted with a relief valve 56 set at the desired target pressure. Following a typical irradiation time of about ten minutes, the recovery outlet tube 48 is opened, and the pump is used for about three minutes to wash new target solution from a source 58 through the target chamber to recover and transport the radioactive effluent at a rate of about 1.5 milliliters per minute. It will be understood, however, that other means, pressures and flow rates can be used, and other liquids or gases can be used to recover and transport the radioactive effluent. Also, other irradiation times and recovery times can be used, and the proton beam can be turned off or left on during recovery flow. Also, it will be understood that by adjusting the size of the recovery outlet tube 48, the pressure of the target chamber during recovery flow can be maintained from just above atmospheric to just below the irradiation pressure.

Means are provided for dissipating heat generated during the bombardment of the target material during the production of the nitrogen-13 atoms. To this end, the target holder portion of the system 10 is provided with a cooling water inlet tube 54 and a cooling water outlet tube 60. While water is a preferred coolant, other known coolants can be used for the cooling of target holder portion.

In the preferred embodiment, therefore, the proton beam 15 passes through the vacuum window 36, the window cooling space 34 filled with flowing helium from the helium jets 43 and the target window 20 before entering the target material 16. As discussed above, the target material 16 is contained in a chamber defined by the target window 20 and the target body 22. The preferred target material for the production of nitrogen-13 atoms and their conversion to nitrogen-13 ammonium ions is a dilute solution of ethanol in natural water. The dilution can be as low as about one part ethanol to 5000 parts of natural water. This target solution is maintained at high pressure within the target chamber where it is washed through by a selected amount of new target solution at selected intervals flowing in the direction of arrow 47 and leaving in the direction of arrow 49. The target window 20 retains the target material.

When this target material 16 is subjected to the proton beam 12, radioactive nitrogen-13 atoms are produced from the oxygen-16 of natural water by the p,$\alpha$ reaction. The chemical form of the nitrogen-13 removed from the target chamber by the one-pass solution (primarily water) flowing in the direction of arrow 49 is predominantly ammonium ion in the aqueous solution due to the solute of the target material, preferably in this case, ethanol. This radioactive water effluent is then transported by the outlet tube 48 through a purification column of conventional design shown generally at 62 to remove any unwanted nitrogen oxides that are present. The resultant purified nitrogen-13 ammonium ion aqueous product is collected for use as is shown generally at 64. In the preferred embodiment, the collection of this nitrogen-13 containing product can be accomplished by simple continuous flow collection, thus precluding complex chemical processing and radioactive decay losses.

Figure 2:
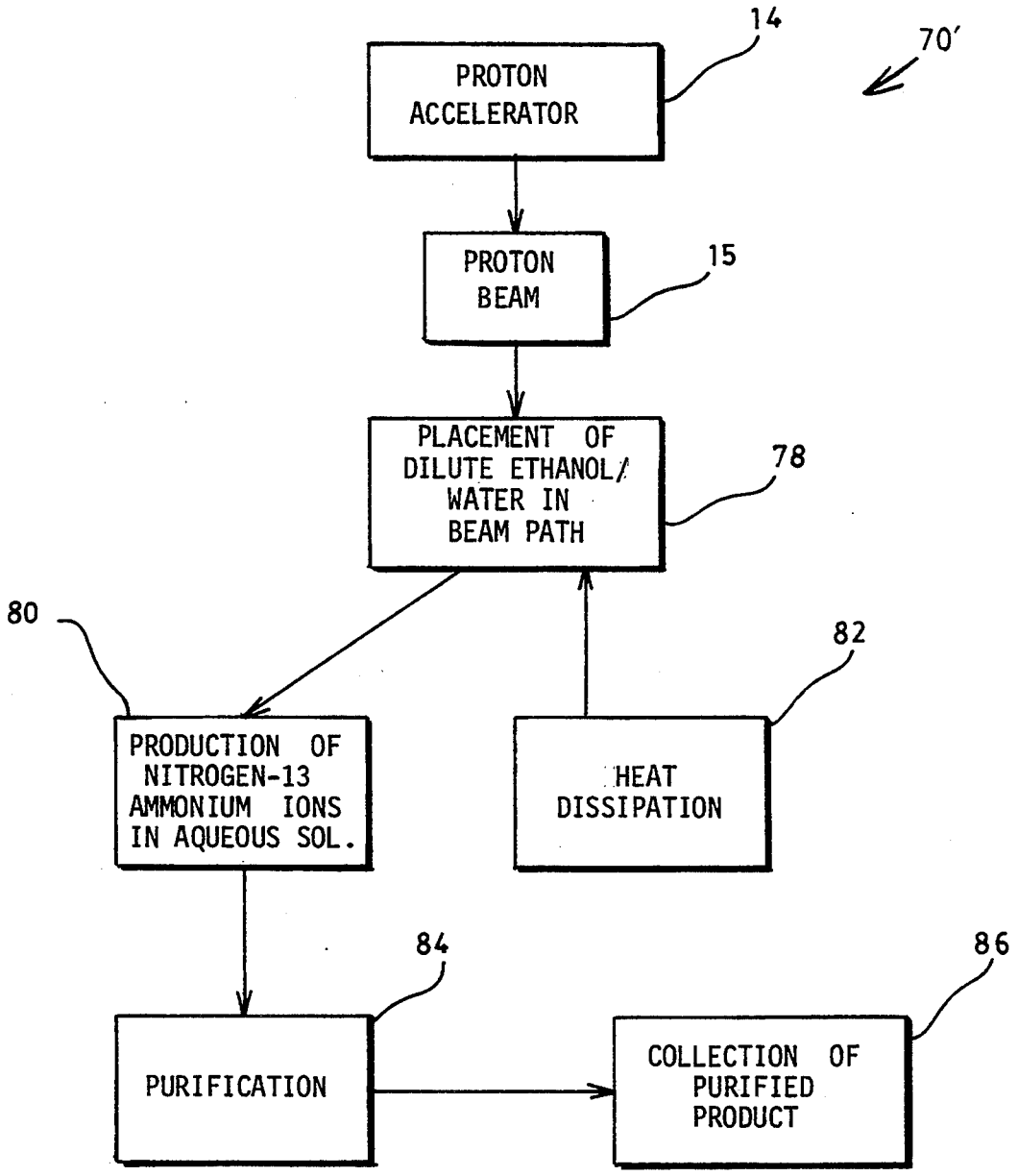
FIG. 2 is a schematic diagram of a process depicting various features of the present invention showing the general steps for utilization of the target of the present invention to produce nitrogen-13 ammonium ion in an aqueous solution.

A process for the production of nitrogen-13 ammonium ions is schematically represented generally at 70 in FIG. 2. The illustrated process 70 utilized a proton accelerator 14 as described above in connection with FIG. 1 to produce a proton beam 15. In the preferred embodiment, the proton accelerator 14 will be a cyclotron providing about 10.5 to 11 MeV protons in a proton beam 15 of about 40 $\mu$A collimated into about a 10 mm diameter. The target material, in the form of a dilute natural water solution of a solute that enhances production of ammonium ion, is placed in the path of the proton beam 15 as indicated at 78. Nitrogen-13 ammonium ions are then produced in aqueous solution as indicated at step 80. Concurrently, it is necessary to provide means for the dissipation of heat generated during production of nitrogen-13 atoms shown generally at 82 (as accomplished by the coolant of helium and water discussed re FIG. 1). The aqueous solution containing the radioactive ammonium ions is then conducted through a purification column in step 84 to remove unwanted nitrogen oxides. The resultant purified product is collected in step 86 for use (this is the same as at 64 in FIG. 1).

As described above, the beam of protons 15 enters the target material 16. These protons interact with the oxygen-16 atom in the p,$\alpha$ nuclear reaction which is characteristically shown by the shorthand notation as follows:

$$^{16}O(p,\alpha)^{13}N \quad (1)$$

where the target atom appears on the left, the reaction type is in the middle, and the product on the right. Thus, radioactive nitrogen-13 is produced in the natural water by the proton reaction with oxygen-16.

The radioactive nitrogen-13 atoms thus produced recoil and diffuse in the water aided by the solute (ethanol). This can be expressed by the shorthand notation:

$$^{13}N \rightarrow {}^{13}NH_4^+ \quad (2)$$

The nitrogen-13 radioactive atom traveling in the dilute ethanol/water solution slows down, ionizes, and picks up hydrogen to form the ammonium ion.

In the reaction shown in Equation 2, above, the majority of the $^{13}N$ product is in the form of the ammonium ion. The balance is produced in two forms of nitrogen oxides: nitrate and nitrite. These nitrogen oxides are easily removed by running the aqueous solution through an ion exchange column to obtain the purified nitrogen-13 ammonium ion product for collection.

As compared with the prior art methods, the present invention produces about two-thirds of the activity in about one-half the time using about two-thirds the proton energy as with just the bombardment of water. Further, it produces about four times the activity in about the same time as with the bombardment of the carbon-13 slurry. The present invention makes use of three features not found in the prior art: high pressure; a very dilute ethanol solution; and a target volume many times larger than needed to stop the bombarding protons. These combine to assure that the nitrogen-13 activity is primarily in the ammonium ions in solution in contrast to being in nitrogen oxides as in the prior art.

From the foregoing it will be recognized by those versed in the art that an improved device and method have been developed for the production of nitrogen-13 ammonium ions. The device and method substantially overcome the disadvantages of cost, time and activity loss of the prior art. Although certain specific values are given, these are for illustrative purposes only and not to limit the invention. Rather, the invention is to be limited only by the appended claims and their equivalents when read with the complete description of the invention.

We claim:

1. A process for the production of nitrogen-13 ammonium ions in an aqueous solution, which comprises:

positioning a target material within a target chamber, said target material consisting essentially of a dilute solution of solute in natural water, said solute selected from the group consisting of ethanol and acetic acid, said target material having a solute:water ratio of about 1:5000;

irradiating said target material within said target chamber with a beam of protons to produce nitrogen-13 atoms by a reaction of said protons with oxygen-16 within said target material, said nitrogen-13 atoms producing nitrogen-13 ammonium ions within said target material in the presence of said solute;

removing heat from said target chamber during said irradiation of said target material with said protons;

flowing said target material, after said irradiation by said protons, from said target chamber with additional target material to separation means to remove said nitrogen-13 ammonium ions from nitrogen-13 oxides in said irradiated target material; and collecting said nitrogen-13 ammonium ions.

2. The process of claim 1 wherein said solute is ethanol.

3. The process of claim 1 further comprising separating said nitrogen-13 oxides from said nitrogen-13 ammonium ions after removing said nitrogen-13 oxides and ammonium ions from said target chamber and prior to said collecting of said nitrogen-13 ammonium ions.

4. The process of claim 1 further comprising maintaining a pressure upon said target material during said irradiation and during said flowing of said additional target material thereby enhancing efficiency of said irradiation of said target material by said protons.

5. A process for the production of nitrogen-13 ammonium ions in an aqueous solution, which comprises:

positioning a target material in a target chamber, said target material consisting essentially of a dilute solution of ethanol in natural water, with an ethanol:water ratio of about 1:5000;

irradiating said target material within said target chamber with a beam of energetic protons to produce nitrogen-13 atoms through the reaction of said protons with oxygen-16 in said target material, said nitrogen-13 atoms producing nitrogen-13 ammonium within said target material in the presence of said ethanol;

removing heat from said target chamber during said irradiation of said target material with said protons;

maintaining said target material under pressure during said irradiating step;

passing additional target material through said target chamber after said irradiating step to remove said nitrogen-13 atoms from said target material as nitrogen-13 ammonium ions and nitrogen-13 oxides in an aqueous solution;

separating said nitrogen-13 ammonium ions from said nitrogen-13 oxides; and collecting said nitrogen-13 ammonium ions.

6. The process of claim 4 wherein said pressure maintained upon said target material is about twenty seven atmospheres.

7. The process of claim 5 wherein said pressure maintained upon said target material is about twenty seven atmospheres.

* * * * *